US006645320B2

(12) United States Patent
Asai et al.

(10) Patent No.: US 6,645,320 B2
(45) Date of Patent: Nov. 11, 2003

(54) STEEL SHEET EXCELLENT IN DUCTILITY AND STRENGTH STABILITY AFTER HEAT TREATMENT

(75) Inventors: Tatsuya Asai, Kakogawa (JP); Tetsuo Soshiroda, Kakogawa (JP)

(73) Assignee: Kobe Steel, Ltd., Kobe (JP)

( * ) Notice: Subject to any disclaimer, the term of this patent is extended or adjusted under 35 U.S.C. 154(b) by 0 days.

(21) Appl. No.: 10/015,633

(22) Filed: Dec. 17, 2001

(65) Prior Publication Data

US 2002/0114724 A1 Aug. 22, 2002

(30) Foreign Application Priority Data

Dec. 15, 2000 (JP) ..... 2000-382802

(51) Int. Cl.[7] ..... C22C 38/32; C22C 38/22

(52) U.S. Cl. ..... 148/330; 148/333; 148/334; 420/121; 420/123; 420/104; 420/105; 420/106

(58) Field of Search ..... 148/330, 333, 148/334; 420/121, 123, 104, 105, 106

(56) References Cited

U.S. PATENT DOCUMENTS 5,997,662 A 12/1999 Norio

FOREIGN PATENT DOCUMENTS

| | | | |
|---|---|---|---|
| JP | 11-152541 | 6/1996 | |
| JP | 2000-144319 | 5/2000 | |
| JP | 2000-248338 | 9/2000 | |
| SU | 1019005 | * 5/1983 | ..... 148/330 |

OTHER PUBLICATIONS

Patent Abstracts of Japan, JP 11–335776, Dec. 7, 1999.

Patent Abstracts of Japan, Jp 11–080882, Mar. 26, 1999.

Patent Abstracts of Japan, JP 11–256272, Sep. 21, 1999.

K. A. Taylor, Database CA Online, Chemical Abstracts, AN 115:96508, XP–002196942, 1 page, "Hardenability and Mechanical Properties of 0.5Mo–B Steels: Direct Quenching Vs. Reheat Quenching", 1990.

* cited by examiner

*Primary Examiner*—Deborah Yee
(74) *Attorney, Agent, or Firm*—Oblon, Spivak, McClelland, Maier & Neustadt, P.C.

(57) ABSTRACT

There is provided a steel sheet which can simultaneously achieves the following objects: high strength is obtained by quenching with reliability; and excellent ductility is ensured, and further which is excellent in corrosion resistance, plating properties, and spot weldability. The steel sheet is so configured as to satisfy the following composition requirements: on a mass basis, C: 0.11 to 0.22%, Mn: 0.1 to less than 0.5%, Cr and/or Mo: a total amount of 0.1 to 0.5%, and B: 0.0005 to 0.005%, where C: the content of C (% by mass), Cr: the content of Cr (% by mass), and Mo: the content of Mo (% by mass), wherein T≧0.19 where T=C+(Cr+Mo)/5.

12 Claims, 6 Drawing Sheets

STEEL SHEET EXCELLENT IN DUCTILITY AND STRENGTH STABILITY AFTER HEAT TREATMENT

BACKGROUND OF THE INVENTION

1. Field of the Invention

The present invention relates to a steel sheet to be formed for use in manufacturing a structural component in an industrial field of automobile, electric machinery, machine, or the like. More particularly, it relates to a steel sheet which, as characteristics, has excellent ductility, and ensures high strength irrespective of variations in the heat treatment conditions (below, such a characteristic may be referred to as "strength stability after a heat treatment" or "strength stability after quenching"), and is further also excellent in corrosion resistance, plating properties, and spot weldability. It is noted that the steel sheet of the present invention is used in the aforesaid various fields. Below, a description will be proceeded centering on the case where the steel sheet is used as a steel sheet for an automobile as a typical use example.

2. Description of the Related Art

As the characteristic required of a structural component for an automobile obtained by forming a steel sheet, mention may be made of a characteristic that the structural component is deformed to absorb a shock without being completely destructed upon automobile crash from the viewpoint of safety. In order to ensure such a characteristic, an increase in strength has been accomplished by increasing the sheet thickness of a part of the structural component, superimposing a reinforcing member thereon, and the like. Incidentally, in recent years, weight reduction has been pursued from the viewpoint of fuel economy enhancement of an automobile. Accordingly, a more increase in strength of a steel sheet has been pursued so as to ensure the safety even without achieving the reinforcement, and the like. However, since a high strength steel sheet is generally poor in workability, it is also required to simultaneously ensure the workability at the time of forming the structural component. As a means for attaining such an object, JP-A-152541/1999 proposes a high strength steel sheet member of which strength has been partially increased by quenching the required portions after forming a steel sheet having a relatively high ductility. Further, JP-A-144319/2000 discloses a technology in which the strength and the workability are ensured by addition of Mn.

In such a steel product, C, Mn, or the like is added in a relatively large amount for the purpose of increasing the strength after quenching. An increase in amount of C added increases the strength after quenching. However, the weldability, and the like become more likely to be deteriorated inversely with the strength improvement. Therefore, the content of Mn in place of C is increased. However, if the Mn amount is increased, the two phase region temperature of the steel is decreased. Accordingly, a hard phase such as martensite or bainite tends to be formed upon recrystallization annealing after cold rolling. In consequence, the ductility of the material is reduced. For this reason, when the steel sheet is used as a steel sheet for an automobile, or the like, which is subjected to a complex processing, it is important that the Mn content is controlled to ensure more excellent ductility.

Incidentally, a quenching treatment is performed for increasing the strength of the structural component as described above. However, when quenching is accomplished by any of the methods of high frequency induction quenching, press quenching, and the like, the heating temperature or the cooling start temperature tends to vary by about 50° C. Accordingly, the strength after quenching also becomes likely to vary with such a variation in quenching temperature. For this reason, there is a problem that a given high strength cannot be ensured as the structural component.

FIG. 1 is a graph showing the relationship between the quenching temperature and the tensile strength after quenching by Mn concentration. The experiment conditions are as follows. Namely, a high Mn steel containing C: 0.13% and Mn: 1.5%, and a low Mn steel containing C: 0.16% and Mn: 0.38% are respectively hot rolled under the conditions of a finishing delivery temperature (FDT) of 890° C., and a coiling temperature (CT) of 650° C. to a sheet thickness of 2 mm. Then, the respective sheets are cold rolled to a sheet thickness of 1 mm, followed by annealing at 720° C. for 60 seconds. Finally, the respective sheets are skin passed for 1% rolling. Flat sheets each with dimensions of 1.0 mm×30 mm×300 mm are cut from the respective rolled steel sheets. The cut sheets are respectively quenched at an each temperature of 700° C., 800° C., 850° C., 900° C., 950° C., or 1050° C. Then, JIS No. 5 test specimens are collected therefrom. Each specimen is subjected to a tensile test to determine the tensile strength.

As shown in FIG. 1, it is possible to suppress the variations in strength after quenching with changes in quenching temperature by raising the quenching temperature, adding a large amount of Mn, or achieving improvement in terms of facilities. However, if the quenching temperature is raised, the plating adhesion of the quenched site in a plated steel sheet is deteriorated, the plated layer disappears, or coatability of the hot rolled steel sheet or the cold rolled steel sheet is deteriorated. As a result, the corrosion resistance is undesirably deteriorated.

FIG. 2 is a graph showing the relationship between the quenching temperature and the iron content of the plating layer. FIG. 3 is a graph showing the relationship between the iron content of the plating layer and the maximum hole depth in a corrosion resistance test. FIG. 2 is based on the experiment conditions as follows. Namely, each continuously cast slab is hot rolled to a thickness of 4.0 mm, followed by acid cleaning. Then, the rolled slab is rolled to a thickness of 2.0 mm by cold rolling, and then subjected to a plating treatment (coating weight of plating: 45 g/m$^2$ per side for both sides) in a hot dip galvanizing line, annealing, and alloying, and quenching is performed in the same manner as with FIG. 1. Further, FIG. 3 is based on the following experiment conditions. Namely, by using each of the steel sheets subjected to quenching as described above, a corrosion resistance test is performed under the conditions in accordance with JASO (automotive material corrosion testing method). In the test, by using each test specimen with dimensions of 2.0 mm×70 mm×150 mm, the maximum hole depth has been determined after 170 cycles, wherein one cycle covers 8-hour salt spray (35° C., 5% salt water), 4-hour drying (60° C., relative humidity 30%), and 2-hour wetting (50° C., relative humidity 90%).

FIGS. 2 and 3 indicate as follows. Namely, if the quenching temperature of the plated steel sheet is too high, plating alloying proceeds to excess, so that the Fe content of the plating layer tends to increase. If the Fe content of the plating layer increases in such a manner, rust tends to occur. Accordingly, the maximum hole depth in the corrosion resistance test is increased. In other words, the corrosion resistance is deteriorated.

In such a case where the material is a plated steel sheet the corrosion resistance of the quenched site depends upon the alloying degree due to quenching or the residual degree of the plating layer. If the quenching temperature is raised, the plating alloying proceeds to excess, or the plating layer disappears. As a result, the anti-corrosive effect due to the plating layer is lost.

FIG. 4 is a graph showing the relationship between the quenching temperature of the cold rolled steel sheet and the coating residual rate, and based on the following experiment conditions. Namely, each steel sheet is manufactured under the same conditions as those for FIGS. 2 and 3, except that a plating treatment is performed. The coating residual rate is determined by subjecting the quenched steel sheet to a phosphate treatment and electrodeposition coating, and then performing a cross-cut adhesion test.

FIG. 4 indicates as follows. If the quenching temperature of the cold rolled steel sheet or the hot rolled steel sheet is raised, the coating residual rate decreases. This is attributable to the following fact. If the quenching temperature is high, the oxide scale layer occurred on the quenched site increases in thickness. Accordingly, even if coating is applied onto the scale layer, the coating layer becomes likely to peel off together with the scale layer. If the coating film peels off in this way to reduce the coating residual rate, there arises a concern about the proceeding of corrosion.

Further, there also arises the following problem. If the quenching temperature is raised, the thermal deformation of a formed article is increased. Whereas, when Mn is added in a large amount in order to inhibit variations in strength after quenching, it becomes difficult to ensure the ductility as described above.

Therefore, in order that a low Mn concentration is adopted for ensuring the ductility, and further that the corrosion resistance is made comparable to that of the unquenched site by reducing the thickness of the oxide scale layer of the quenched site or inhibiting the plating alloying, quenching is required to be performed in a relatively low temperature region of from 850 to 950° C. In such a case, variations in strength after quenching present a problem.

However, no technology worthy of special note has been developed up to now for reducing such variations in strength after quenching. In JP-A-248338/2000, the present inventors have already proposed a steel sheet for high frequency induction quenching in which a wide range of Mn concentration region is specified. However, no consideration is given even to the variations in strength after quenching in a low Mn concentration region as in the present invention.

SUMMARY OF THE INVENTION

The present invention has been completed in view of the foregoing circumstances. It is therefore an object of the present invention to provide a useful steel sheet which is capable of simultaneously achieving the reliable acquisition of the excellent ductility ensuring a complex forming, and a high strength after quenching irrespective of variations in heat treatment temperature conditions, and further which is excellent in corrosion resistance, plating properties, and spot weldability.

A steel sheet in accordance with the present invention satisfies the following composition requirements: on a mass basis, C: 0.11 to 0.22%, Mn: 0.1 to less than 0.5%, Cr and/or Mo: a total amount of 0.1 to 0.5%, and B: 0.0005 to 0.005%, where C, Cr, and Mo denote their respective percentages of the elements by mass, wherein T=C+(Cr+Mo)/5 is 0.19 or more.

Under the foregoing circumstances, the present inventors have pursued a close study with the aim of implementing a steel sheet which is excellent in ductility, and ensures the high strength after quenching, and further which is also excellent in corrosion resistance of the quenched site. As a result, they have ascertained that it is effective to specify particularly the C amount, and the Cr amount, and/or the Mo amount in combination. Their continued pursuit of the study on the quantitative effects of these chemical components has led to the present invention.

Below, the reason why the chemical components are specified in the present invention will be described in details.

C: 0.11 to 0.22%

C is an element required for enhancing the quenching property of steel to ensure the high strength. If the content thereof is too small, a desired strength is difficult to be obtained even when sufficient quenching is performed. Therefore, it is added in an amount of 0.11% or more, and preferably 0.12% or more. However, if the C content is too large, the spot weldability is deteriorated. Accordingly, when welding is performed, the welded site becomes brittle. Therefore, the C content is controlled at 0.22% or less, and preferably 0.20% or less.

Mn: 0.1 to less than 0.5%

FIG. 5 is a graph showing the elongation of a steel sheet with respect to the Mn content, and based on the following experiment conditions. Namely, steel samples having their respective C and Mn contents shown in FIG. 1 below are respectively hot rolled under the conditions of a finishing delivery temperature (FDT) of 890° C., and a coiling temperature (CT) of 650° C. to form steel sheets each having a sheet thickness of 2 mm. Then, JIS No. 5 test specimens are collected from the resulting steel sheets. Each specimen is subjected to a tensile test to determine the tensile strength. FIG. 5 indicates that the elongation, i.e., the ductility is dramatically improved by controlling the Mn content. In the present invention, the Mn content has been controlled at less than 0.5%, preferably less than 0.45%, and more preferably 0.4% or less in order to ensure excellent ductility.

TABLE 1

| Steel type No. | C mass % | Mn mass % | Hot rolled sheet elongation % |
|---|---|---|---|
| 1 | 0.16 | 0.35 | 37 |
| 2 | 0.16 | 0.55 | 32 |
| 3 | 0.16 | 1.00 | 31 |
| 4 | 0.16 | 1.50 | 29 |

On the other hand, Mn is also an element which is effective for enhancing the quenching property of steel to ensure high strength as with C, and which is also effective for achieving the stabilization of the strength after quenching as shown in FIG. 1 above. Therefore, the lower limit of the Mn content is set at 0.1% and preferably 0.2%.

Cr and/or Mo: a total amount of 0.1 to 0.5%

Cr and Mo are important elements for ensuring the strength stability after quenching. Therefore, they are required to be added in a total amount of 0.1% or more, and preferably 0.2% or more. However, for either element of Cr and Mo, if the content thereof is too large, non-plating, or deterioration in property of the chemical conversion coating such as a phosphate treatment is caused, or poor plating adhesion (non-plating) during manufacturing occurs. Therefore, the total amount of both the elements to be added is required to be controlled at 0.5% or less, and preferably 0.4% or less.

B: 0.0005 to 0.005%

B is an element required for enhancing the quenching property to obtain a sufficiently quenched structure even at a low temperature. In order for such an effect to be effectively exerted, it is required to be added in an amount of 0.0005% or more, and preferably 0.001% or more. However, if the B content is too large, an iron nitride is caused to precipitate in a large amount, resulting in deteriorated ductility. Therefore, the amount of B to be added is controlled at 0.005% or less, and preferably at 0.004% or less.

$T \geqq 0.19\%$, where $T=[C]+([Cr]+[Mo])/5$, wherein [C]: the content of C (%), [Cr]: the content of Cr (%), and [Mo]: the content of Mo (%).

T serves as an index for the variations in strength after quenching (a difference between the tensile strength after quenching at a quenching temperature of 850° C. and the tensile strength after quenching at a quenching temperature of 950° C.). In order for the variations in strength to fall within a desirable range (100 or less), T is required to be 0.19 or more in such a range that the C amount, and the total amount of Cr or/and Mo specified in the present invention are satisfied. However, if the value of T is too large, the hardness of the welded portion is increased more than necessary. Therefore, the value of T is desirably 0.28 or less.

FIG. 6 is a graph showing the amount of C and the total amount of Cr and Mo specified in the present invention. The indexes plotted in the graph denote the variations in strength specified in this patent application (a difference between the tensile strength after quenching at a quenching temperature of 850° C. and the tensile strength after quenching at a quenching temperature of 950° C.). As apparent from FIG. 6, the variations in strength after quenching is inhibited by satisfying the specified range of this patent application.

According to the present invention, as described above, sufficiently excellent ductility is ensured by controlling the Mn content. In addition, the variations in strength after quenching is inhibited by adding C, and Cr and Mo in respective amounts specified in the present invention. Further, the quenching property is enhanced by adding C and B in combination. Consequently, it is possible to obtain the high strength of a steel sheet with reliability. Still further, by specifying the components as described above, it is also possible to ensure the spot weldability and the corrosion resistance after quenching.

Typical chemical composition in the present invention is as described above. However, if required, it is also effective to obtain the following improvement effect by adding Ti and Al in adequate amounts therein. Namely, Ti is effective for allowing B not to precipitate as a nitride, and to remain in the solid solution state for enhancing the quenching effect of B. Therefore, it is preferably added in an amount of 0.01% or more. However, if the amount of Ti added is too large, the ductility is deteriorated. For this reason, it is controlled at 0.04% or less. Whereas, Al is effective as a deoxidizing material. However, if the content thereof is too large, the number of surface defects such as scabs and slivers increases. Therefore, the content thereof is preferably set at 0.06% or less, and more preferably at 0.05% or less.

The elements contained in the steel sheet of the present invention are as described above. The balance component is substantially Fe. As a matter of course, it is acceptable that trace amounts of inevitable impurities are contained in the steel sheet. It is also possible that still other elements are positively contained therein in such a range as not to adversely affect the function of the present invention. Examples of the still other elements allowed to be positively added include Si, Cu, Ni, and the like, having the quenching property improvement effect.

Incidentally, the present invention is not intended to specify even the manufacturing method of the steel sheet. The steel sheet of the present invention may be the one obtained by performing hot rolling, optionally followed by cold rolling. Alternatively, it may be the plated steel sheet obtained by performing rolling, and then a plating treatment. Further, the present invention is not also intended to specify the conditions of the reheating temperature, the finishing rolling temperature, cooling, coiling, and the like in the hot rolling, the conditions of the cold rolling reduction, the recrystallization annealing, and the like in the cold rolling, or the conditions of the type of a plating bath, the plating bath temperature, the coating weight of plating, the plating alloying treatment, and the like in a plating treatment.

Further, the present invention is not also intended to specify the quenching method. It is applicable to the case where quenching is performed with any heat treatment method such as the case of high frequency heating—quenching (high frequency induction quenching), heating in a heating furnace—quenching, or the case where quenching is performed in a die simultaneously with forming after heating (press quenching).

Below, the present invention will be described more specifically by way of examples, which should not be construed as limiting the scope of the present invention. The present invention is capable of being practiced or carried out by appropriately adding the variations thereto without departing from the gists described above and below. All the variations are included within the technical range of the present invention. Namely, in the following examples, cold rolled steel sheets or plated steel sheets are used as final products, and the heat treatment is accomplished by a high frequency induction quenching method. However, as described above, the present invention is not intended to specify the conditions for manufacturing a steel sheet. It is also included within the scope of the present invention that the present invention is applied to the ones manufactured under various manufacturing conditions.

DETAILED DESCRIPTION OF THE PREFERRED EMBODIMENTS

EXAMPLE

Each of the steel samples meeting their respective chemical compositions shown in Table 2 was smelted to manufacture a slab with a thickness of 230 mm. Then, the resulting slab was used, and hot rolled under the conditions shown in Table 3 to a sheet thickness of 2.0 mm. Thereafter, the resulting sheet was further cold rolled to obtain a steel sheet with a thickness of 1.0 mm. The samples Nos. 10 to 12 shown in Tables 2 and 3 are obtained by annealing the steel sheets resulting from cold rolling at their respective temperatures shown in Table 3 for 40 seconds, and then finally subjecting the annealed sheets to skin pass rolling (elongation of 1%) Whereas, each of the samples Nos. 1 to 9 is the one subjected to a plating treatment in the following manner. Namely, each of the steel sheets resulting from cold rolling is annealed at each of the temperatures shown in Table 3 for 40 seconds, and then subjected to a hot dip galvanizing treatment. Further, alloying of the plating is performed at each of the temperatures shown in Table 3. Finally, skin pass rolling (elongation of 1%) is performed.

From each of the steel sheets thus obtained, three flat sheets each with dimensions of 1.0 mm×30 mm×300 mm were cut for respective quenching temperatures of 850° C., 900° C., and 950° C., and high frequency induction quenching thereof was performed. The quenching was accomplished in the following manner. Each of the flat sheets was fed from a steel sheet guide into between high frequency coils arranged in opposed relation to each other, and subjected to quenching throughout the flat sheet at each quenching temperature of 850° C., 900° C., or 950° C. Immediately upon reaching the quenching temperature, shower cooling was performed. Thereafter, a JIS No. 5 test specimen was manufactured from each flat sheet. Then, a tensile test was performed to determine the tensile strength (TS). The strength deviation (ΔTS) shown in Table 3 denotes the difference between the TS minimum value of the samples quenched at 850° C. and the TS maximum value of the samples quenched at 950° C.

Figure 1:
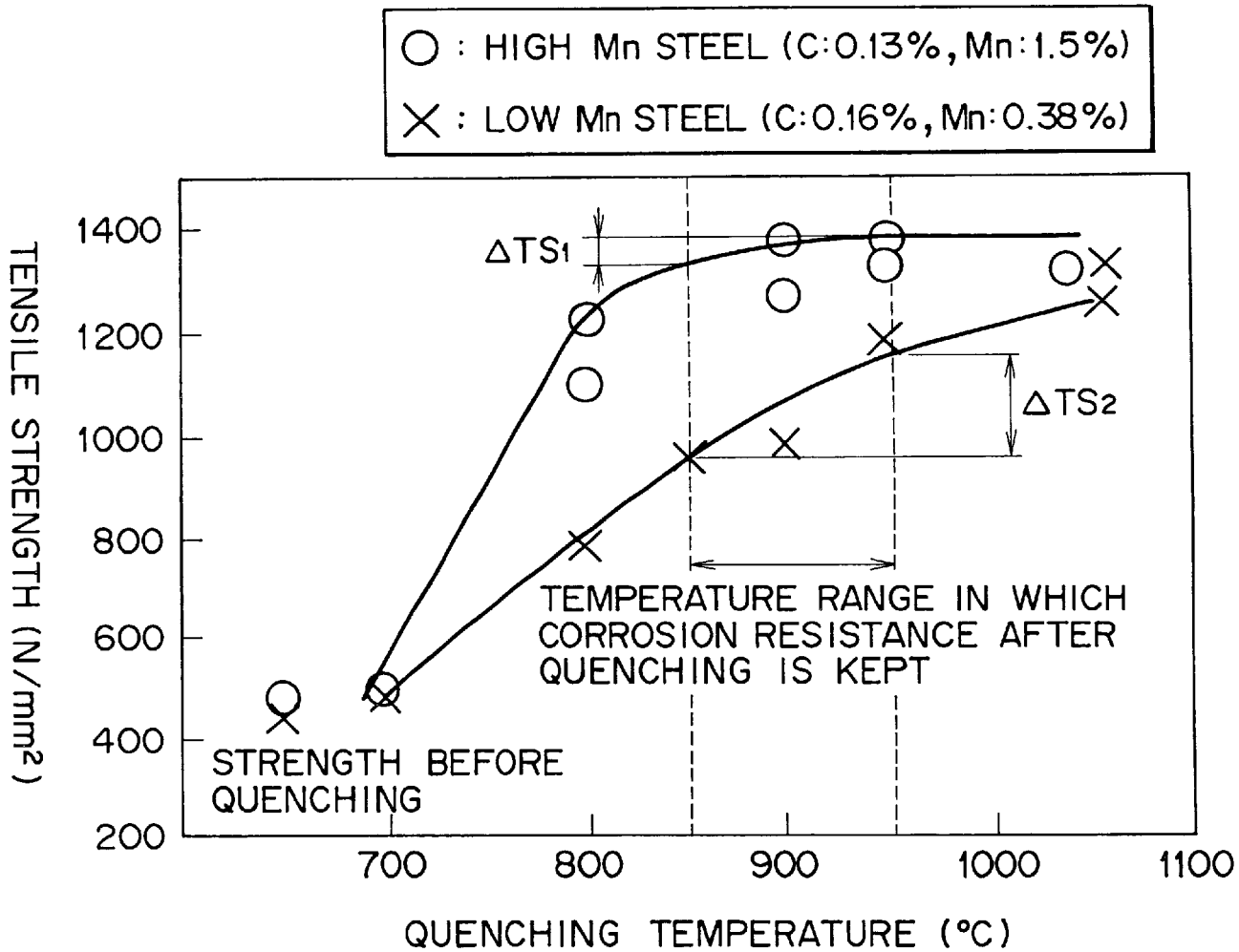
FIG. 1 is a graph showing the relationship between the quenching temperature and the tensile strength after quenching by Mn concentration.
Figure 2:
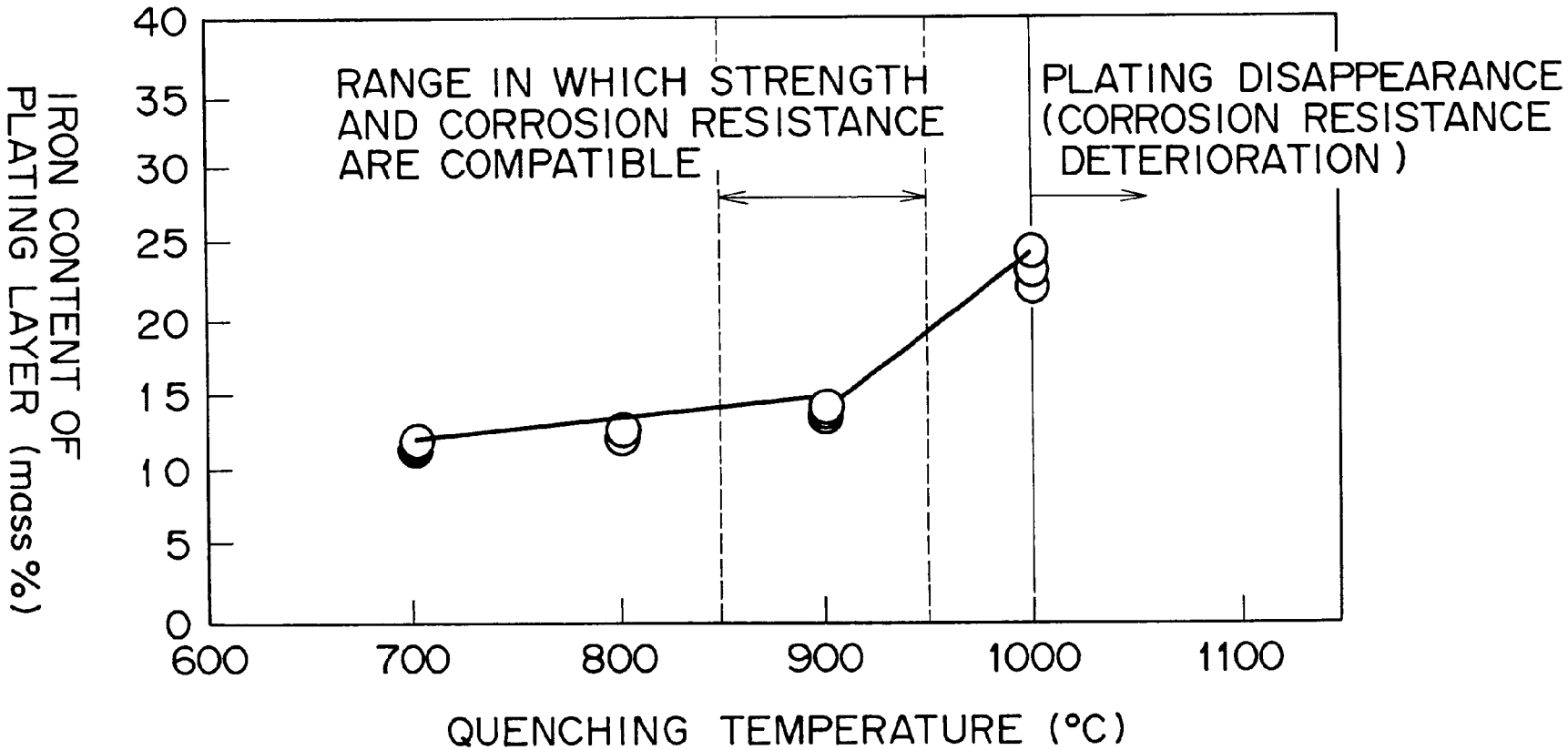
FIG. 2 is a graph showing the relationship between the quenching temperature and the iron content of a plating layer.
Figure 3:
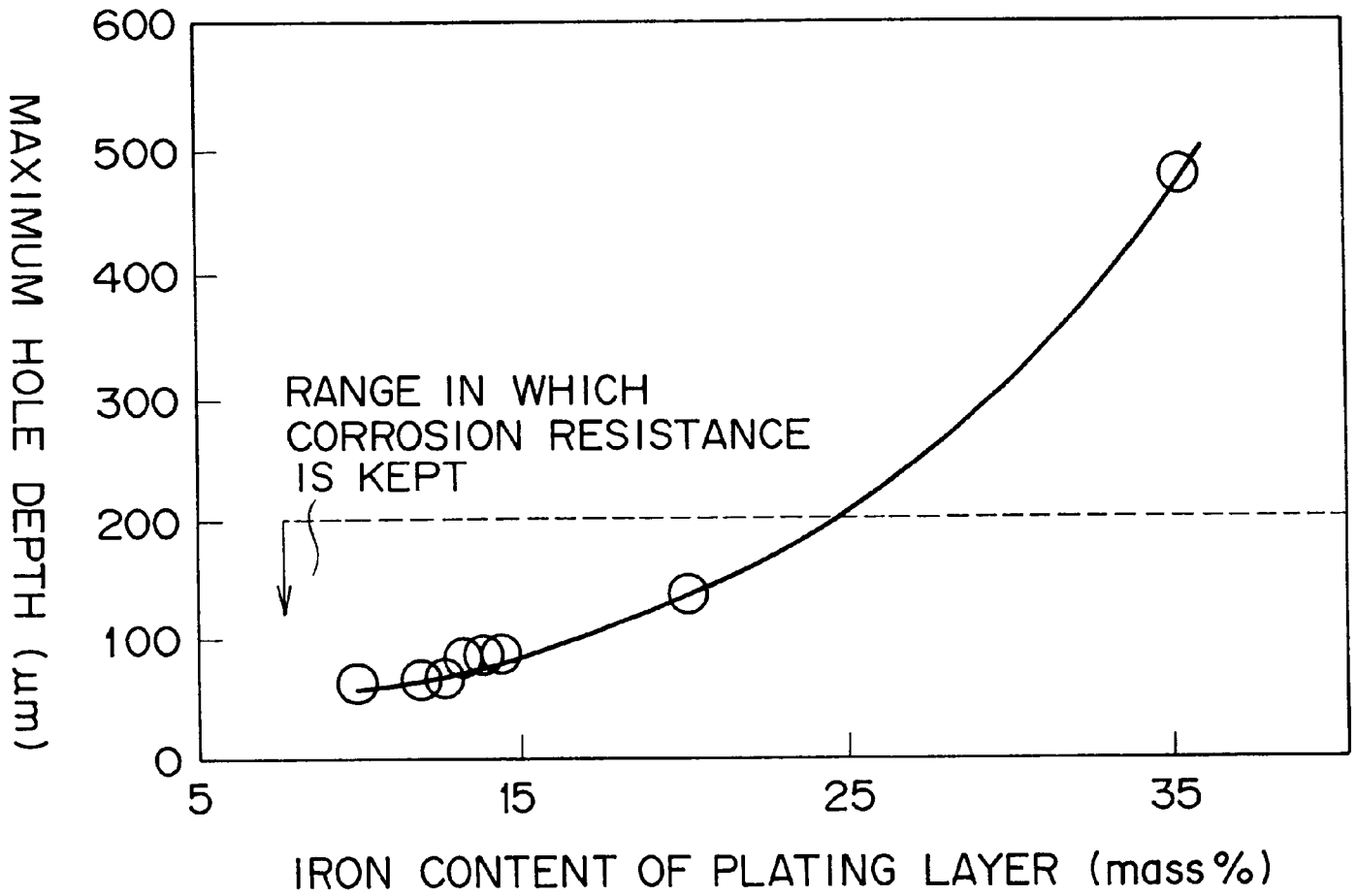
FIG. 3 is a graph showing the relationship between the iron content of the plating layer and the maximum hole depth in a corrosion resistance test.
Figure 4:
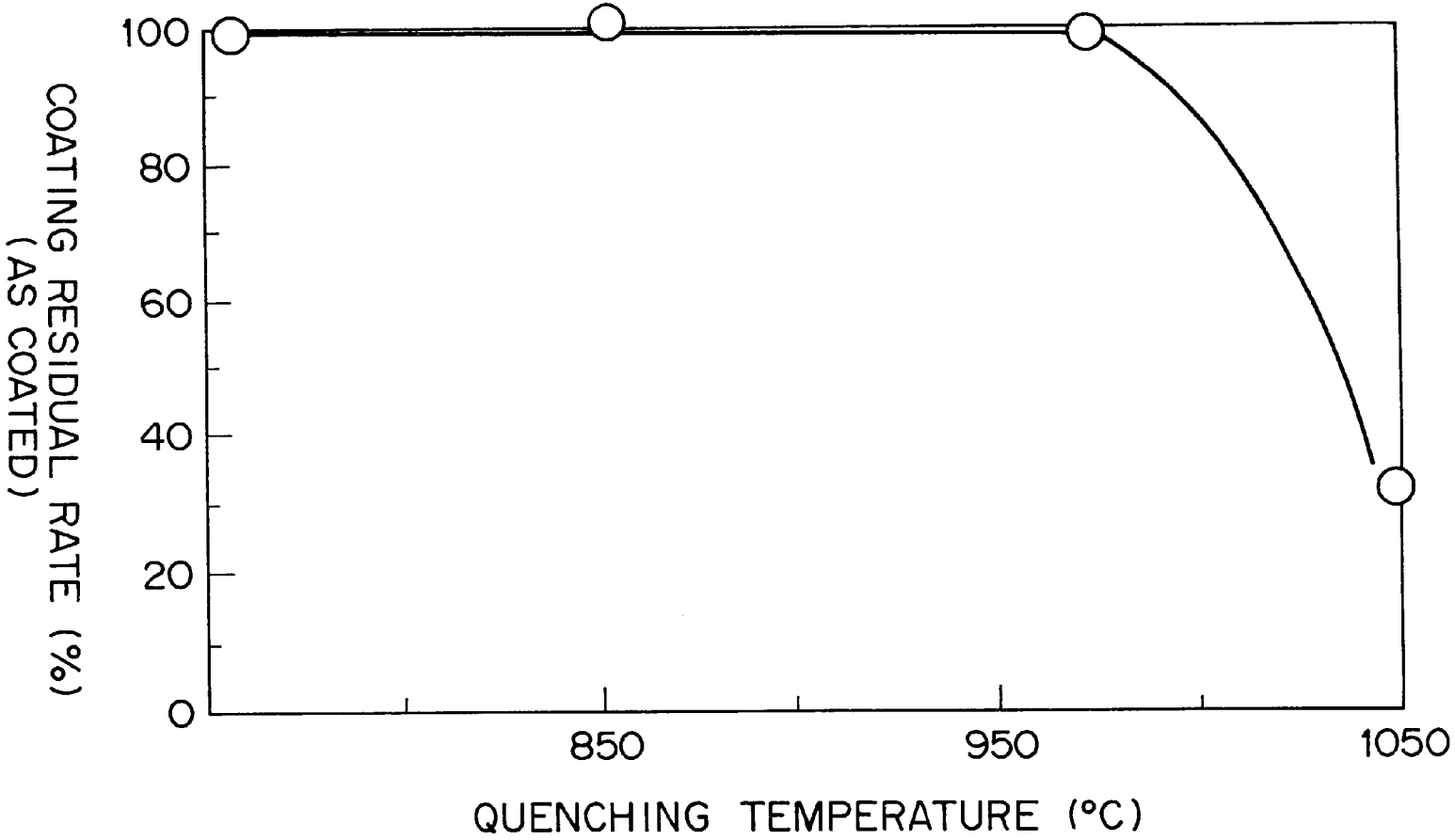
FIG. 4 is a graph showing the relationship between the quenching temperature and the coating residual rate.
Figure 5:
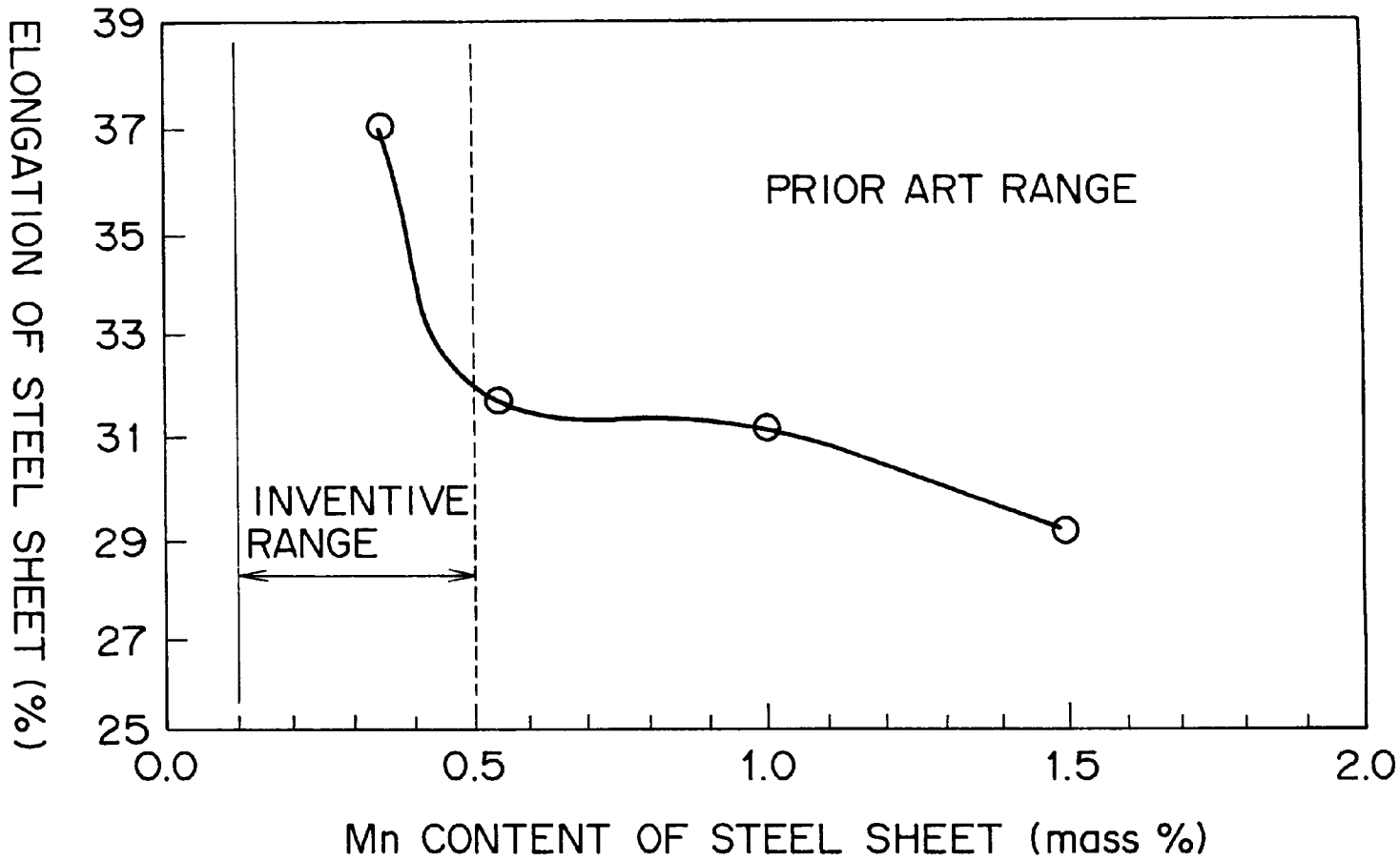
FIG. 5 is a graph showing the relationship between the Mn content of a steel sheet and the elongation of the steel sheet.
Figure 6:
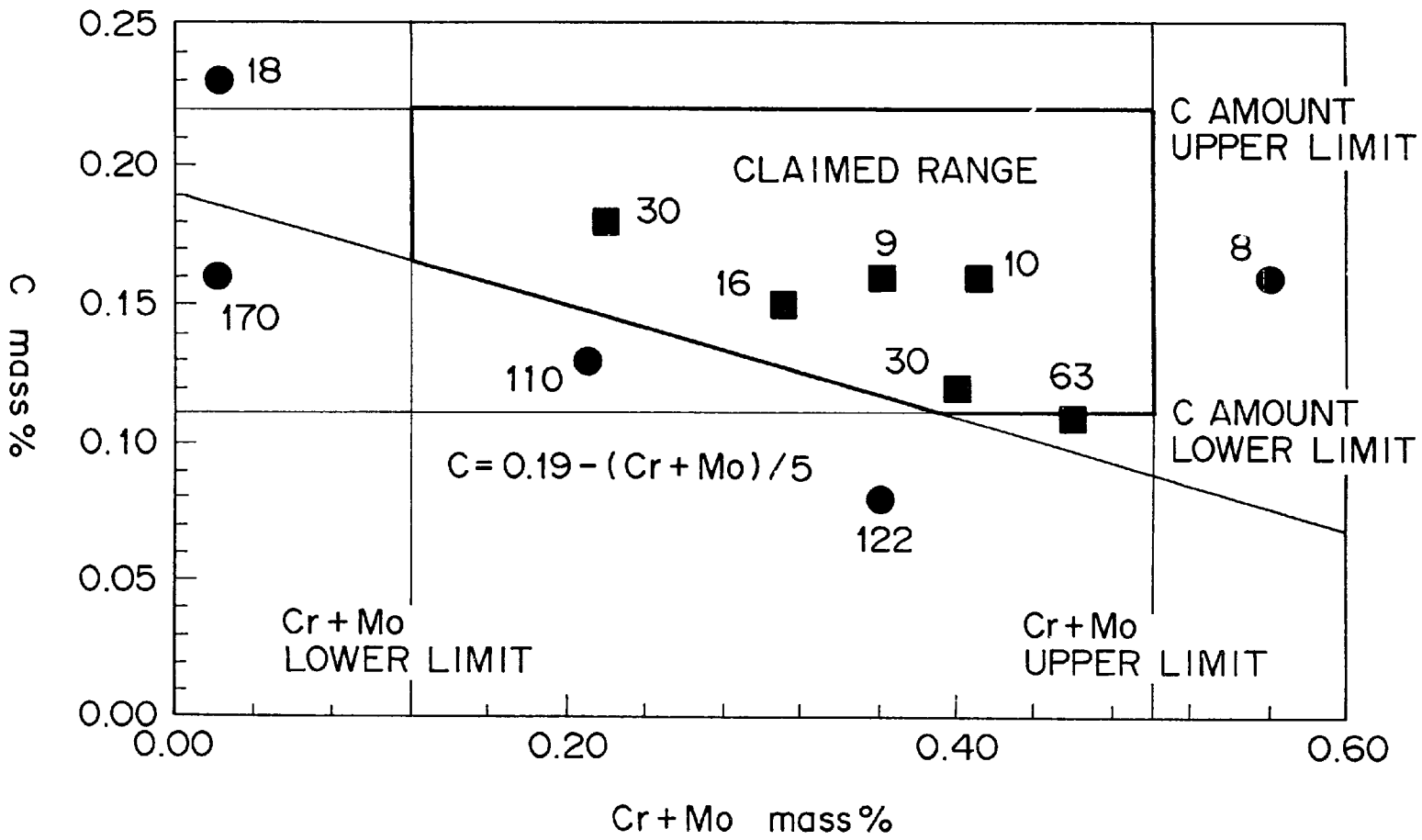
FIG. 6 is a graph showing the strength deviation (a difference between the tensile strength after quenching at a quenching temperature of 850° C. and the tensile strength after quenching at a quenching temperature of 950° C.) of steel sheets having their respective C content, and Cr and/or Mo content.

Incidentally, the mechanical properties of each steel sheet prior to quenching shown in FIG. 3 are expressed as the yield point (YP), the tensile strength (TS), and the elongation (El), which have been determined in the following manner. A sheet having the same size as that of the flat sheet is cut from the steel sheet prior to quenching to manufacture a JIS No. 5 test specimen, and a tensile test is performed.

Whereas, the evaluation of the plating property was carried out by judging the obtained plating treated steel sheet having a good surface property as "○", and the one undergone the occurrence of non-plating as "×". These results are additionally shown in Table 3.

TABLE 2

| | Material chemical component | | | | | | | | | | | | | |
|---|---|---|---|---|---|---|---|---|---|---|---|---|---|---|
| No. | C | Mn | Cr | Mo | Al | B | N | Ti | P | S | Si | Cr + Mo | T = C + (Cr + Mo)/5 | Note |
| 1 | 0.08 | 0.38 | 0.35 | 0.01 | 0.035 | 0.0008 | 0.0031 | 0.019 | 0.010 | 0.005 | 0.01 | 0.360 | 0.152 | Comparative |
| 2 | 0.16 | 0.38 | 0.01 | 0.40 | 0.037 | 0.0006 | 0.0035 | 0.021 | 0.009 | 0.007 | 0.01 | 0.410 | 0.242 | Inventive |
| 3 | 0.11 | 0.38 | 0.45 | 0.01 | 0.045 | 0.0007 | 0.0044 | 0.022 | 0.012 | 0.008 | 0.01 | 0.460 | 0.202 | Inventive |
| 4 | 0.15 | 0.38 | 0.30 | 0.01 | 0.032 | 0.0006 | 0.0051 | 0.021 | 0.011 | 0.005 | 0.01 | 0.310 | 0.212 | Inventive |
| 5 | 0.13 | 0.38 | 0.01 | 0.20 | 0.036 | 0.0007 | 0.0040 | 0.018 | 0.010 | 0.005 | 0.01 | 0.210 | 0.172 | Comparative |
| 6 | 0.12 | 0.38 | 0.39 | 0.01 | 0.028 | 0.0010 | 0.0030 | 0.020 | 0.012 | 0.006 | 0.01 | 0.400 | 0.200 | Inventive |
| 7 | 0.16 | 0.38 | 0.55 | 0.01 | 0.026 | 0.0010 | 0.0040 | 0.019 | 0.009 | 0.008 | 0.01 | 0.560 | 0.272 | Comparative |
| 8 | 0.12 | 1.50 | 0.02 | 0.02 | 0.031 | 0.0008 | 0.0030 | 0.020 | 0.012 | 0.005 | 0.01 | 0.040 | 0.128 | Comparative |
| 9 | 0.16 | 0.38 | 0.01 | 0.01 | 0.033 | 0.0010 | 0.0035 | 0.019 | 0.011 | 0.005 | 0.01 | 0.020 | 0.164 | Comparative |
| 10 | 0.23 | 0.38 | 0.01 | 0.01 | 0.035 | 0.0010 | 0.0033 | 0.019 | 0.010 | 0.005 | 0.01 | 0.020 | 0.234 | Comparative |
| 11 | 0.16 | 0.35 | 0.35 | 0.01 | 0.033 | 0.0007 | 0.0045 | 0.021 | 0.011 | 0.007 | 0.01 | 0.360 | 0.232 | Inventive |
| 12 | 0.18 | 0.31 | 0.20 | 0.02 | 0.004 | 0.0008 | 0.0035 | 0.018 | 0.010 | 0.007 | 0.01 | 0.220 | 0.224 | Inventive |
| | mass % | | | | | | | | | | | | | |

TABLE 3

| | Manufacturing conditions | | | | | Material mechanical properties | | | Plating properties | Characteristics after quenching | | | |
|---|---|---|---|---|---|---|---|---|---|---|---|---|---|
| No. | Type | Hot rolling finishing temperature | Hot rolling coiling temperature | Cold rolled sheet annealing temperature | Plating alloying temperature | YP | TS | El | | TS at 850° C. | TS at 950° C. | ΔTS | Note |
| 1 | GA | 895 | 650 | 718 | 690 | 296 | 400 | 37.2 | ○ | 1122 | 1244 | 122 | Comparative |
| 2 | GA | 935 | 657 | 721 | 690 | 296 | 423 | 37.7 | ○ | 1395 | 1405 | 10 | Inventive |
| 3 | GA | 900 | 667 | 730 | 690 | 307 | 445 | 37.4 | ○ | 1183 | 1246 | 63 | Inventive |
| 4 | GA | 900 | 630 | 700 | 690 | 322 | 424 | 37.0 | ○ | 1396 | 1412 | 16 | Inventive |
| 5 | GA | 896 | 640 | 722 | 690 | 325 | 465 | 35.5 | ○ | 1271 | 1381 | 110 | Comparative |
| 6 | GA | 898 | 665 | 726 | 690 | 320 | 450 | 37.3 | ○ | 1256 | 1286 | 30 | Inventive |
| 7 | GA | 910 | 662 | 718 | 690 | 351 | 475 | 34.9 | X | 1474 | 1482 | 8 | Comparative |
| 8 | GA | 880 | 661 | 730 | 690 | 340 | 445 | 32.3 | ○ | 1350 | 1357 | 7 | Comparative |
| 9 | GA | 886 | 640 | 719 | 690 | 258 | 456 | 36.2 | ○ | 980 | 1150 | 170 | Comparative |
| 10 | Cold rolled | 888 | 630 | 700 | — | 300 | 430 | 37.2 | — | 1412 | 1458 | 16 | Comparative |
| 11 | Cold rolled | 900 | 600 | 720 | — | 270 | 465 | 36.5 | — | 1450 | 1459 | 9 | Inventive |
| 12 | Cold rolled | 905 | 610 | 721 | — | 275 | 459 | 37.5 | — | 1513 | 1543 | 30 | Inventive |
| | | ° C. | | | | N/mm² | | % | | | N/mm² | | |

The experimental results shown in Tables 2 and 3 indicate as follows. Namely, the samples Nos. 2 to 4, 6, 11, and 12 satisfy the requirements of the present invention, and provide steel sheets each of which has good ductility, shows a small range of variations in strength after quenching, and has good plating properties, and hence undergoes no occurrence of non-plating. In contrast, the samples Nos. 1, 5, 7 to 10 do not satisfy the requirements of the present invention. Therefore, it has been shown that any of the ductility, the strength stability after quenching, the plating properties, or the weldability is inferior.

Namely, it has been shown that the sample No. 1 shows a wider range of variations in strength after quenching because of the insufficient C content.

The sample No. 5 satisfies the requirements for the C content, and the Cr and/or Mo content, but does not satisfy the requirements for T. Therefore, it has been shown that the sample No. 5 exhibits a wider range of variations in strength after quenching.

The sample No. 10 has the C content in excess of the upper limit specified in this patent application, and hence it shows deteriorated weldability.

The sample No. 7 has the Cr and/or Mo content in excess of the specified range. Therefore, it has been shown that an oxide is formed on the basis material steel sheet prior to plating to cause the occurrence of non-plating.

Whereas, the sample No. 8 shows a smaller range of variations in strength after quenching, but has the Mn content in excess of the specified amount. Therefore, it has been shown that the ductility is inferior.

It is noted that the sample No. 10 is shown as a reference example. If C is added in a large amount in excess of the specified range of the present invention in this manner, it is possible to reduce the range of variations in strength after quenching. However, undesirably, it becomes difficult to ensure the spot weldability.

The present invention is constituted as described above. By appropriately controlling the chemical composition as described above, it has been possible to achieve the following objects simultaneously: high strength is obtained by quenching with reliability; and excellent ductility is ensured. Further, it has been also possible to ensure excellent corrosion resistance, plating properties, and spot weldability. Then, the implementation of such a steel sheet excellent in ductility and strength stability after quenching has enabled supply of a steel sheet for an automobile, a steel sheet for construction, a steel sheet for a mechanical structural member, or the like, which is required to undergo complex forming and have high strength.

What is claimed is:

1. A steel sheet excellent in ductility and strength stability after a heat treatment, comprising: by mass, C: 0.11 to 0.22%, Mn: 0.1 to less than 0.5%, Cr and/or Mo: a total amount of 0.1 to 0.5%, and B: 0.0005 to 0.005%, where C: the content of C (% by mass), Cr: the content of Cr (% by mass), and Mo: the content of Mo (% by mass), wherein $T \geqq 0.19$ where $T=C+(Cr+Mo)/5$.

2. The steel sheet according to claim 1, wherein C is 0.12% or more.

3. The steel sheet according to claim 1, wherein Mn is less than 0.45%.

4. The steel sheet according to claim 1, wherein Mn is 0.4% or less.

5. The steel sheet according to claim 1, wherein Cr and/or Mo is 0.4% or less.

6. The steel sheet according to claim 1, wherein B is 0.004% or less.

7. The steel sheet according to claim 1, wherein T is 0.28 or less.

8. The steel sheet according to claim 2, wherein T is 0.28 or less.

9. The steel sheet according to claim 3, wherein T is 0.28 or less.

10. The steel sheet according to claim 4, wherein T is 0.28 or less.

11. The steel sheet according to claim 5, wherein T is 0.28 or less.

12. The steel sheet according to claim 6, wherein T is 0.28 or less.

* * * * *